US005827996A

United States Patent [19]

Yoshida et al.

[11] Patent Number: 5,827,996

[45] Date of Patent: Oct. 27, 1998

[54] AIR BAG GAS GENERATING COMPOSITION

[75] Inventors: Tadao Yoshida, Soka; Yasuo Shimizu; Kazuo Hara, both of Tokushima; Shiro Chijiwa, Osaka; Junichi Onishi, Tokushima, all of Japan

[73] Assignee: Otsuka Kagaku Kabushiki Kaish, Osaka, Japan

[21] Appl. No.: 849,526

[22] PCT Filed: Sep. 24, 1996

[86] PCT No.: PCT/JP96/02760

§ 371 Date: May 29, 1997

§ 102(e) Date: May 29, 1997

[87] PCT Pub. No.: WO97/12848

PCT Pub. Date: Apr. 10, 1997

[30] Foreign Application Priority Data

| | | | |
|---|---|---|---|
| Sep. 29, 1995 | [JP] | Japan | 7/253309 |
| Dec. 27, 1995 | [JP] | Japan | 7/340614 |
| Aug. 13, 1996 | [JP] | Japan | 8/213415 |

[51] Int. Cl.[6] ..... C06B 29/00; C06B 31/00

[52] U.S. Cl. ..... 149/45; 149/37; 149/61; 149/83; 149/109.2

[58] Field of Search ..... 149/36, 37, 45, 149/46, 61, 75, 76, 77, 83, 88, 109.2

[56] References Cited

U.S. PATENT DOCUMENTS

| | | | |
|---|---|---|---|
| 5,035,757 | 7/1991 | Poole | 149/46 |
| 5,531,941 | 7/1996 | Poole | 264/3.4 |

*Primary Examiner*—Joseph D. Anthony
*Attorney, Agent, or Firm*—Knobbe, Martens, Olson & Bear, LLP

[57] ABSTRACT

A gas-generating composition for air bags, which provides low explosion risk and low toxicity, has at least one gas-generating base selected among urazol and metal salts thereof, as the active ingredient, and an oxidizing agent. Urazol and metal salts thereof can effectively generate gas at a low burning temperature when in combination with the oxidizing agent.

8 Claims, No Drawings

AIR BAG GAS GENERATING COMPOSITION

This application is a 371 of PCT/JP96/02760 filed on Sep. 24, 1996.

TECHNICAL FIELD

The present invention relates to an air bag gas generating composition.

The air bag gas generating composition according to the present invention possesses advantageous characteristics of suitable burning performance, low burning temperature, low concentration of toxic components such as CO and NOx in the gas generated by the combustion (hereinafter referred to as "after gas"), and remarkably higher safety than conventional azide-based gas generating compositions.

BACKGROUND ART

As the requirements concerning driving safety become more rigorous, the demand for air bag systems is greatly increasing. When a car travelling at high speed is in a crash, the air bag system inflates a nylon bag (air bag) stowed in the steering wheel assembly, the dashboard or the like to thereby protect the occupants from being injured or killed by the impact against the interior of the car. The bag is inflated with a gas generated by the combustion or decomposition of a gas generating composition held in the system.

The air bag gas generating composition is required to have a number of performance characteristics, among which the following four are important requirements. First, the gas generating composition should have appropriate burning velocity. For reducing the impact on the occupants smashing into the air bag, the bag deflates to some extent immediately after the inflation, releasing part of the gas inside the car. If the burning velocity is too high, the occupants smash into the bag before deflation, whereas if the burning velocity is low, the bag is not inflated immediately after the crash. In both cases, the bag can not protect the occupants. The second requirement is low burning temperature, i.e., low after gas temperature. High after gas temperature may impair the bag and cause the occupants to sustain burns, and moreover, may burn the bag and cause fire. The third requirement is low concentration of toxic components such as CO and NOx in the after gas. If the after gas is high in the concentration of toxic components, the occupants are likely to be poisoned by the after gas released inside the car from the deflating bag. The fourth requirement is that the shock ignitability (sensitivity to shock ignition) is low. High shock ignitability involves a high possibility of explosion or detonation in the course of production, e.g., in the mixing or molding process, and thus entails a high risk in handling.

Azide-based gas generating compositions comprising sodium azide as the gas generating base, which are generally used at present, show adequate burning velocity and gas temperature, and the gas generated therefrom mainly comprises nontoxic nitrogen gas. However, said composition has a drawback of high shock ignitability. Further, since sodium azide used as the gas generating base causes a fire or toxic fume on decomposition, or forms toxic substances such as sodium oxide and sodium hydroxide on reaction with an oxidizing agent, handling thereof requires constant and close care, and protection equipment is essential for assuring safety. Moreover, since the absorption of moisture leads to a decrease in the burning performance of sodium azide, there must be a provision for the prevention of moisture absorption. In addition, sodium azide is highly toxic, and thus it is possible that serious environmental pollution will be caused by the spread of sodium azide when an air bag-equipped car is fallen into a river or the sea or experiences floods, or when an air bag-equipped car is scrapped with a cutter.

Recently, people have acknowledged the great importance of environmental protection and safety of operators and users. The azide-based gas generating compositions are not preferred due to the above drawbacks. Accordingly, an azide-free gas generating base substituting for sodium azide is earnestly demanded to be developed.

Azide-free gas generating bases heretofore proposed include nitrogen-containing organic compounds having an amide group, such as azodicarbonamide of the chemical structural formula $H_2NOCN{=}NCONH_2$ (Japanese Unexamined Patent Publications Nos. 32,689/1994, 32,690/1994 and 227,884/1994, WO 94/01381, etc.), biscarbamoylhydrazine of the chemical structural formula $H_2NOCHNNHCONH_2$ (Japanese Unexamined Patent Publications Nos. 300,383/1995 and 143,388/1996, DE-A-19,516,818 and the like) and dicyanamide of the chemical structural formula $H_2NC(NH)NHCN$ (specification of U.S. Pat. No. 4,386,979). In particular, research is made for the practical use of azodicarbonamide and biscarbamoylhydrazine which are generally used as foaming agents for synthetic resins, since they are very easily available, inexpensive and remarkably low in toxicity and shock ignitability, and the gas generated by the combustion of these compounds contains very small amount of toxic substances (such as CO and NOx).

However, there is room for improvement in the thermal decomposition properties and storage stability of gas generating compositions comprising azodicarbonamide as a gas generating base. On the other hand, the crystal of biscarbamoylhydrazine have a scale or plate shape, in which the binding force between the particles is weak. As a result, gas generating compositions comprising biscarbamoylhydrazine as a gas generating base have poor moldability, and thus it is difficult to form the composition into desired pellets. Even if pellets can be formed, they easily disintegrate.

DISCLOSURE OF THE INVENTION

An object of the present invention is to provide an air bag gas generating composition which is remarkably lower in burning temperature, equivalent or lower in the concentration of toxic components such as CO and NOx in the after gas, equivalent in burning velocity, shock ignitability, safety, etc., and remarkably lower in explosion risk and toxicity, compared with the conventional azide-free gas generating compositions.

Another object of the present invention is to provide an air bag gas generating composition which is remarkably improved in storage stability, good in moldability and free from disintegration of the obtained pellets, compared with conventional azide-free gas generating compositions.

Other features of the present invention will become apparent from the following description.

The present invention provides an air bag gas generating composition comprising, as active components, at least one gas generating base selected from urazol or a metal salt thereof, and an oxidizing agent.

The present invention also provides the above air bag gas generating composition further comprising at least one member selected from the group consisting of a burning catalyst, a burning control agent and a slagging agent.

The air bag gas generating composition of the present invention is remarkably lower in burning temperature, equivalent or lower in the concentration of toxic components such as CO and NOx in the after gas, equivalent in burning velocity, shock ignitability, safety, etc., lower in explosion risk and toxicity, and good in storage stability and moldability, compared with the conventional azide-free gas generating compositions.

Urazol and its metal salts, which are used as the gas generating base in the air bag gas generating composition of the present invention, have been heretofore considered not to have gas generating capability. The present inventors first found that urazol or a metal salt thereof, when heated in combination with an oxidizing agent, generates nontoxic gas. The present invention has been accomplished based on this finding.

Since urazol and its metal salts have higher heat stability and remarkably higher stability to alkali than azodicarbonamide, use thereof advantageously broadens the selection range of the oxidizing agent, burning catalyst and the like, and contributes to the significant improvement in the storage stability of the gas generating composition of the present invention. Further, unlike biscarbamoylhydrazine, the crystal form of urazol and its metal salts does not affect the moldability of the gas generating composition. Moreover, urazol and its metal salts are very low in toxicity and explosion risk, and thus contributes to the improvement in the safety of the gas generating composition of the present invention.

The metal salts of urazol are not limited specifically, and include, for example, alkali metal salts such as potassium salt and sodium salt, alkali earth metal salts such as calcium salt, magnesium salt and strontium salt. Among them, potassium salt, which is free from crystallization water, is particularly preferred.

According to the present invention, at least one gas generating base selected from urazol or a metal salt thereof is used. It is preferred that urazol is used in combination with a metal salt thereof. The combined use further reduce the concentration of toxic components. When urazol is used in combination with a metal salt thereof, they may be mixed before being added. Alternatively, a mixture of urazol and an inorganic salt, an organic salt or the like is formulated into pellets, which are then calcined at usually about 100° C. or more, preferably about 120° C. or more for about 0.5 to about several hours, to react urazol with the inorganic salt, organic or like salt for forming a metal salt of urazol. Usable inorganic and organic salts are not limited specifically and include those known. Inorganic salts of metals are particularly preferred. Specific examples of the inorganic salts of metals are metal carbonates such as potassium carbonate, sodium carbonate, calcium carbonate, magnesium carbonate and strontium carbonate, metal oxides such as potassium oxide, sodium oxide, calcium oxide, magnesium oxide and strontium oxide, hydroxides such as potassium hydroxide, sodium hydroxide, calcium hydroxide, magnesium hydroxide and strontium hydroxide, and the like. When urazol is mixed with a carbonate or a hydroxide of an alkali metal, a metal salt of urazol is formed by mere mixing, without calcining. The inorganic salt and/or organic salt of a metal is used in an amount that does not convert the whole of urazol into its metal salt.

The inorganic salt of a metal is also used as burning catalyst and burning control agent, as described below. When using the inorganic salt of a metal as burning catalyst or burning control agent, the obtained pellets are not calcined. However, when using a carbonate or a hydroxide of an alkali metal, it is necessary to use the carbonate or hydroxide of an alkali metal in an amount larger than the amount that converts the whole quantity of urazol into an alkali metal salt.

According to the present invention, commercially available urazol and metal salts thereof can be used as such. The particle size of these compounds is not limited specifically, and can be properly selected from a wide range in accordance with, for example, the amount used, proportions to other components such as the oxidizing agent, volume of the air bag and other conditions.

The oxidizing agent, another active component of the gas generating composition of the present invention, is not limited specifically and can be selected from those conventionally used in this field. Preferred are those capable of generating and/or feeding oxygen at high temperatures, for example, oxohalogen acid salts, nitrates, nitrites, metallic peroxides, hyperoxides, ozone compounds, etc.

Usable oxohalogen acid salts include those known, for example, perhalogenates, halogenates and the like. Examples of perhalogenates are alkali metal salts such as lithium perchlorate, potassium perchlorate, sodium perchlorate, lithium perbromate, potassium perbromate and sodium perbromate, alkali earth metal salts such as magnesium perchlorate, barium perchlorate, calcium perchlorate, magnesium perbromate, barium perbromate and calcium perbromate, ammonium salts such as ammonium perchlorate and ammonium perbromate, and the like. Examples of useful halogenates are alkali metal salts such as lithium chlorate, potassium chlorate, sodium chlorate, lithium bromate, potassium bromate and sodium bromate, alkali earth metal salts such as magnesium chlorate, barium chlorate, calcium chlorate, magnesium bromate, barium bromate and calcium bromate, ammonium salts such as ammonium chlorate and ammonium bromate, and the like. Among them, alkali metal salts of halogen acids and perhalogen acids are preferred.

Examples of the nitrate are alkali metal salts such as lithium nitrate, sodium nitrate and potassium nitrate, alkali earth metal salts such as magnesium nitrate, barium nitrate and strontium nitrate, ammonium salts such as ammonium nitrate, and the like. Among them, alkali metal salts and alkali earth metal salts are preferred, and potassium nitrate and strontium nitrate are particularly preferred.

Examples of nitrites include alkali metal salts such as lithium nitrite, sodium nitrite and potassium nitrite, alkali earth metal salts such as magnesium nitrite, barium nitrite and calcium nitrite.

Examples of the hyperoxides include alkali metal compounds such as sodium hyperoxide and potassium hyperoxide, alkali earth metal compounds such as calcium hyperoxide, strontium hyperoxide and barium hyperoxide, rubidium hyperoxide, cesium hyperoxide and the like.

Examples of the ozone compounds include compounds represented by the formula $MO_3$ wherein M is a Group Ia element such as Na, Kr Rb, Cs or the like. In the present invention, metal sulfides such as molybdenum disulfide, bismuth-containing compounds, lead-containing compounds and the like can be used as the oxidizing agent.

Among these oxidizing agents, oxohalogen acid salts, nitrates and nitrites are preferred, and oxohalogen acid salts and nitrates are particularly preferred. They can be used singly or as a mixture of two or more. Commercially available products of these oxidizing agents can be used as such, and the shape, particle size and the like are not limited specifically, and can be properly selected in accordance with, for example, the amount of the oxidizing agent used, proportions to other components, volume of the air bag and other conditions.

The oxidizing agent is used usually in a stoichiometric amount sufficient to completely oxidize and burn the gas generating base, calculated on the basis of the amount of oxygen. The amount of the oxidizing agent can be properly selected from a wide range, since the burning velocity, burning temperature (gas temperature), composition of the combustion gas, etc. can be adjusted as desired by suitably changing the proportions of the gas generating base and oxidizing agent. For example, the oxidizing agent is suitably used in a proportion of about 10 to about 400 wt. parts, preferably about 100 to about 240 wt. parts, per 100 wt. parts of the gas generating base.

One of the preferred embodiments of the air bag gas generating gas composition according to the present invention comprises the above gas generating base and an oxo-halogen acid salt and a nitrate as the oxidizing agent.

The gas generating composition of the present invention may further contain, in addition to the above two components, at least one member selected from the group consisting of a burning catalyst, a burning control agent and a slagging agent.

The burning catalyst is considered to serve mainly to decrease the burning temperature and reduce the concentrations of CO and/or NOx in the gas. Usable burning catalysts include oxides of the metals of the 4th to 6th periods in the periodic table, oxygen-containing metallic compounds which form said metal oxides when heated, heteropolyacids and the like.

Specific examples of the oxides of metals of the 4 to 6 periods in the periodic table are copper oxide, nickel oxide, cobalt oxide, iron oxide, chromium oxide, manganese oxide, zinc oxide, calcium oxide, titanium oxide, vanadium oxide, cerium oxide, holmium oxide, ytterbium oxide, molybdenum oxide, tungsten oxide, antimony oxide, tin oxide, titanium oxide and the like. Among them, copper oxide, nickel oxide, cobalt oxide, molybdenum oxide, tungsten oxide, iron oxide, tin oxide, zinc oxide and chromium oxide are preferred, and CuO, CoO, NiO, $Ni_2O_3$, $MoO_3$, $Cr_2O_3$, $TiO_2$, SnO, ZnO and $Fe_2O_3$ are particularly preferred. These metal oxides include hydrates thereof, for example, hydrates of tungsten oxide, such as $WO_3 \cdot H_2O$. It is preferred that the metal oxide have a BET specific surface area of at least 5 $m^2/g$, more preferably at least 10 $m^2/g$, still more preferably at least 40 $m^2/g$. Among the above mentioned metal oxides, CuO, MoO, $WO_3$ and the like have an advantageous characteristic of the capability of reducing the CO concentration and NOx concentration at the same time.

The oxygen-containing metal compound which form, when heated, the oxides of metals of the 4th to 6th periods in the periodic table are not limited specifically, and those conventionally known can be used. For example, oxygen-containing molybdenum compounds which form $MoO_3$ when heated include Group VIII metal salts of molybdic acid such as cobalt molybdate and nickel molybdate, molybdic acid and molybdenum hydroxide, and the like. Oxygen-containing tungsten compounds which form $WO_3$ when heated include, for example, tungstic acid, metal salts thereof, and the like. Examples of the metal salts of tungstic acid include alkali metal salts such as lithium tungstate, potassium tungstate and sodium tungstate, alkali earth metal salts such as calcium tungstate and magnesium tungstate, Group VIII metal salts of tungstic acid such as cobalt tungstate, nickel tungstate, iron tungstate and copper tungstate.

Examples of heteropolyacids include phosphomolybdic acid, phosphotungstic acid, metal salts of these acids, and the like. The metal salts of heteropolyacids are not limited specifically and include Group VIII metal salts such as Co salt, Ni salt and Fe salt, Mg salt, Sr salt, Pb salt, Bi salt, etc. Among them, Group VIII metal salts are preferred, and Co salt is particularly preferred.

Among the above burning catalysts, CuO, CoO, NiO, $Ni_2O_3$, $MoO_3$, $WO_3$, oxygen-containing molybdenum compounds which form $MoO_3$ when heated, oxygen-containing tungsten compounds which form $WO_3$ when heated, cobalt phosphomolybdate, $Cr_{23}$, $TiO_2$, SnO, ZnO, $Fe_2O_3$, etc. are particularly preferred, and CoO, NiO, $Ni_2O_3$, $MoO_3$, $WO_3$, Group VIII metal salts of molybdic acid, cobalt phosphomolybdate and the like, etc. are still more preferred.

These burning catalysts can be used singly or as a mixture of two or more.

The particle size of the burning catalyst is not limited specifically, and can be properly selected from a wide range in accordance with, for example, the amount of the burning catalyst used, proportions to the other components, volume of the air bag and other conditions. The amount of the burning catalyst is not limited specifically, and can be properly selected in accordance with, for example, the kinds and proportions of the other components, volume of the air bag and other conditions. It is suitable to use the burning catalyst in an amount of usually about 0.1 to about 150 wt. parts, preferably about 0.5 to about 80 wt. parts, more preferably about 5 to about 30 wt. parts per 100 wt. parts of the total amount of the gas generating base and oxidizing agent.

When using the oxygen-containing metal compound which forms a metal oxide when heated, it is used in an amount that forms the above specified amount of metal oxide.

The burning control agent is used generally to decrease the burning temperature, to control the burning velocity and to prevent the gas generating agent from detonation caused by fire or strong impact in the course of production, transportation or storage.

The following (a) to (i), for example, can be used as the burning control agent.

(a) Powders of metals such as B, Al, Mg, Ti, Zr, Mo, etc.

(b) Oxides, hydroxides, carbonates and bicarbonates of elements of the 3rd period in the periodic table such as B, Al, Mg, Si, etc. (preferably, $B_2O_3$, aluminum hydroxide, bentonite, alumina, diatomaceous earth, silicon dioxide, etc.)

(c) Carbonates, bicarbonates, oxides and hydroxide of alkali metals such as Na, K, etc.

(d) Carbonates, bicarbonates and hydroxides of alkali earth metals such as Ca, Mg, Ba, Sr, etc.

(e) Chlorides, carbonates, sulfates and hydroxides of elements of the 4th to 6th periods in the periodic table other than those mentioned in the above (b) and (c) (for example, Zn, Cu, Fe, Pb, Ti, V, Ce, Ho, Ca, Yb, etc.)

(f) Cellulose compounds such as carboxymethyl cellulose, hydroxymethyl cellulose, their ethers, microcrystalline cellulose powders, etc.

(g) Organic polymeric compounds such as soluble starch, polyvinyl alcohol, partially saponified products thereof, etc.

(h) Organic acids such as organic carboxylic acid, for example, amino acids (e.g., glycine), ascorbic acid, citric acid, etc.

(i) Derivatives of boric acid such as $H_3BO_3$, $HBO_2$, etc.

Among the above burning control agents, substances (a) to (d) and (h) and (i) are preferred, and powders of metals such as B, Al, Ti and Z, metal oxides such as $B_2O_3$ and $Al_2O_3$, carbonates of alkali metals and alkali earth metals such as lithium carbonate and calcium carbonate, metal hydroxides such as aluminum hydroxides, amino acids such as glycine and derivatives of boric acid are particularly preferred.

These burning control agents can be used singly or as a mixture of two or more. Commercially available products of these burning control agents may be used as such. The particle size thereof is not limited specifically, and can be properly selected from a wide range in accordance with, for example, the amount of the burning control agent used, proportions to the other components, volume of the air bag and other conditions.

The amount of the burning control agent is not limited specifically, and can be properly selected from a wide range in accordance with the proportions to the other components, volume of the air bag and other conditions. It is suitable, however, to use the burning control agent in an amount of usually about 0.1 to about 50 wt. parts, preferably about 0.5 to about 30 wt. parts per 100 wt. parts of the total amount of the gas generating base and the oxidizing agent.

The slagging agent is an additive which solidifies the residue of the combustion of the gas generating agent, and thereby facilitates the removal of the residue with the filter in the air bag inflator. Known slagging agents are usable, which include, for example, silicon dioxide and alumina mentioned above as the burning control agent, boron oxide (in particular $B_2O_3$), etc. These slagging agents can be used singly or as a mixture of two or more. The amount of the slagging agent is not limited specifically, and can be properly selected from a wide range in accordance with the formulation of the gas generating composition and other conditions. For example, when silicon dioxide is used as the slagging agent, the molar ratio of the slagging agent to the potassium nitrate is preferably about ½. Also usable as the slagging agent are oxides containing alkali earth metals and alkali earth metal compounds which form oxides by reaction, for example, strontium oxide, strontium nitrate and the like.

Various additives conventionally used in this field and various additives used in azide-free gas generating compositions can be further added in a range which does not adversely affect the advantageous characteristics of the gas generating composition of the present invention.

The following compositions (a) and (b) are preferred gas generating compositions of the present invention.

(a) A gas generating composition comprising the gas generating base of the present invention, an oxidizing agent, a burning catalyst and a slagging agent. Particularly preferred oxidizing agents are potassium perchlorate, potassium nitrate, mixtures of these compounds, and the like. Preferred burning catalysts are copper oxide, nickel oxide, molybdenum oxide and the like. Preferred slagging agent are silicon dioxide and the like.

(b) A gas generating composition comprising the gas generating base of the present invention, an oxidizing agent, a burning control agent and a slagging agent. Preferred oxidizing agents are potassium perchlorate, nitrate, mixtures of these compounds, and the like. Preferred burning control agents include carbonates of alkali earth metals such as calcium carbonate, and the like. Preferred slagging agents are silicon dioxide and the like.

According to the present invention, the gas generating base and/or the oxidizing agent, and optionally other additives, may be surface-treated for further improving the storage stability, facility of preparation and the like of the gas generating composition.

Known surface treating agents are usable which include, for example, coupling agents, inorganic surface-treating agents, and the like. Chelating agents can also be used as the surface treating agent.

The coupling agent is not limited specifically and includes those conventionally known. Examples are silane-based coupling agents such as γ-aminopropyl-triethoxysilane, γ-glycidyloxypropyltrimethoxysilane and methyltrimethoxysilane, titanate-based coupling agents such as isopropyltriisostearoyl titanate, aluminum-based coupling agents such as acetoalkoxyaluminum diisopropylate. Usable inorganic surface treating agents also include those known, among which water-soluble metal salts are preferred. Examples of the water-soluble metal salts are chlorides such as $AlCl_3$, $CoCl_2$, $ZrCl_4$, $SnCl_2$, $SnCl_4$, $TiCl_3$, $TiCl_4$, $FeCl_2$, $FeCl_3$, $CuCl_2$, $NiCl_2$ and $MoCl_5$, nitrates of metals such as Al, Co, Zr, Sn, Ti, Fe, Cu, Ni and Mo, silicates such as $Na_4SiO_4$ and $K_2Si_4O_9$, $ZrCl_2O$, $NaAlO_2$ and the like. Among them, $AlCl_3$, $NaAlO_2$, $FeCl_2$ and $FeCl_3$ are preferred, and $NaAlO_2$ is particularly preferred. Known chelating agents are also usable. Examples are ethylenediamine tetraacetic acid (EDTA) and metal salts thereof (EDTA·disodium salt, EDTA·dipotassium salt, EDTA·dilithium salt, EDTA·diammonium salt, etc.), sodium diethyldithiocarbamate and the like.

These surface treating agents can be used singly or as a mixture of two or more. The amount of the surface treating agent is not limited specifically, and can be properly selected from a wide range in accordance with the kinds and proportions of the components to be treated, such as the gas generating base, oxidizing agent and other components, the kind of the surface treating agent, desired performance characteristics of the resulting gas generating composition and other conditions. It is suitable, however, to use the surface treating agent in a proportion of about 0.01 to 5 wt. %, preferably 0.1 to 2.0 wt. %, based on the total amount of the components to be treated.

The surface treatment can be carried out by a conventional process comprising mixing the component to be treated and the surface treating agent.

When a water-soluble metal salt is used as the surface treating agent, a component can be surface-treated by mixing the component and the water-soluble metal salt in water, neutralizing the mixture and fractionating and drying the resulting solids. The pH adjustor used for neutralization is not limited specifically, and may be a known acid or alkali. Examples of the acid are inorganic acids such as hydrochloric acid, sulfuric acid, oxalic acid, nitric acid and phosphoric acid, organic acids such as acetic acid, and the like. Examples of the alkali are sodium hydroxide, potassium hydroxide, sodium carbonate, potassium carbonate, sodium hydrocarbonate, potassium hydrocarbonate, ammonia, etc. The treated component is dried usually at about 0° to about 250° C., preferably about 50° to about 150° C., taking into consideration the heat decomposition temperature of said component. The drying is carried out usually under normal pressure, but may be done under reduced pressure. The gas generating base may be finely ground or recrystallized before being surface-treated.

The gas generating composition of the present invention is produced by mixing the gas generating base, the oxidizing agent and other optional components.

The gas generating composition of the present invention can be prepared into a suitable shape. For example, a suitable amount of a binder is mixed with the gas generating composition of the present invention, and the mixture is tabletted and optionally dried. For the preparation, a solvent such as water or warm water is preferably added in a suitable amount to assure safety. Useful binders include, for example, those usually used for this purpose. The shape of the preparation is not critical and includes, for example, pellets, disks, balls, bars, hollow cylinders, confetti and tetrapods. It may be solid or porous (e.g. honeycomb-shaped). One or more projections may be formed on one or both surfaces of pellets or disks. The shape of projections is not limited specifically and includes, for example, cylinders, cones, polygonal cones, polygonal pillars, etc.

Alternatively, the respective components may be individually made into a preparation and the preparations may be used as mixed.

The preparation of the gas generating preparation of the present invention is placed into a container made of polyethylene or like synthetic resin or metal, whereby the gas generating preparation can be safely stored and transported.

The air bag gas generating composition of the present invention is not limited to automotive use and can be suitably used as a gas source for air bag systems to be installed in various transport means.

BEST MODE FOR CARRYING OUT THE INVENTION

The present invention is described below in more detail with reference to the following Examples, Comparative Examples and Test Examples. The manufacturers of the starting materials used in these examples are as follows unless otherwise specified. Urazol: product of Otsuka Kagaku K. K. Azodicarbonamide: product of Otsuka Kagaku K. K. Biscarbamoylhydrazine: product of Otsuka Kagaku K. K. Potassium nitrate: product of Otsuka Kagaku K. K. Potassium perchlorate: product of Nihon Carlit Co., Ltd. Silicon dioxide: trade name "Nipseal NS-P", product of Nippon Silica Co., Ltd. Soluble starch: Wako 1st grade product, product of Wako Pure Chemical Industries, Ltd. Copper oxide: specific surface area 48 $m^2/g$, average particle size about 7.4 $\mu$m, product of Nikki Chemical Co. Ltd. Molybdenum oxide (VI): product of Nippon Inorganic Colour & Chemical Co., Ltd.

In the following description, part(s) and percentage are all by weight.

EXAMPLE 1

Thoroughly mixed together were powders of 45 parts of urazol, 57.8 parts of potassium perchlorate, 10 parts of copper oxide (II) and 1 part of silicon dioxide. A 20% aqueous solution of soluble starch was added in an amount that gives a starch content of 1.5 parts, and the mixture was further stirred to give a wet powder. The wet powder was granulated using a granulating machine. The obtained wet granules were dried and compressed using a hydraulic tablet molding machine to give a pellet sample of a gas generating composition (6 mm in diameter, 3 mm in thickness and 0.15 g in weight).

Comparative Example 1

Thoroughly mixed together were powders of 45 parts of azodicarbonamide, 53.6 parts of potassium perchlorate, 10 parts of potassium nitrate, 1 part of silicon dioxide and 3 parts of molybdenum oxide (VI). A 20% aqueous solution of soluble starch was added in an amount that gives a starch content of 1.5 parts, and the mixture was further stirred to give a wet powder. The wet powder was granulated using a granulating machine. The obtained granules were dried and compressed using a tablet molding machine to give a pellet sample of a gas generating composition (6 mm in diameter, 3 mm in thickness and 0.15 g in weight).

Comparative Example 2

Thoroughly mixed together were powders of 45 parts of biscarbamoylhydrazine, 72.1 parts of potassium perchlorate, 10 parts of potassium nitrate, 1 part of silicon dioxide and 5 parts of molybdenum oxide (VI). A 20% aqueous solution of soluble starch was added in an amount that gives a starch content of 3.5 parts, and the mixture was further stirred to give a wet powder. The wet powder was granulated using a granulating machine. The obtained granules were dried and compressed using a tablet molding machine to give a pellet sample of a gas generating composition (6 mm in diameter, 3 mm in thickness and 0.15 g in weight).

Test Example 1

40 g each of the pellet samples of the gas generating compositions obtained in Example 1 and Comparative Examples 1 and 2 was individually filled into a 0.3 mm-thick aluminum cup, and the cup was placed in the combustion chamber of an inflator having a gas outlet 7 mm in diameter and loaded with 0.8 g of boron/potassium nitrate as a transfer charge. The inflator was set in a 60-liter tank and actuated by applying the current, to thereby ignite the pellet sample of the gas generating composition. Then, the pressure and temperature in the inflator and the 60-liter tank were measured. After the burning, the gas in the 60-liter tank was collected into a 1-liter tedlar bag and checked for the CO and NOx concentrations using a detector tube. The results are shown in Table 1.

The symbols in Table 1 stand for the following.

CP max: maximum pressure ($kgf/cm^2$) in the combustion chamber of the inflator

TP max: maximum pressure ($kgf/cm^2$) in the 60-liter tank, a parameter of the gas generating capability of the gas generating composition tTP max: time (msec) in which the internal pressure of the 60-liter tank reaches the maximum, a parameter simulating the velocity of the inflation of the air bag tTP 90: time (msec) in which the internal pressure of the 60-liter tank reaches 90% of the maximum, a parameter simulating the velocity of the inflation of the air bag

TABLE 1

| | Ex. 1 | Comp. Ex.1 | Comp. Ex.2 |
|---|---|---|---|
| CP max ($Kgf/cm^2$) | 170 | 170 | 102 |
| TP max ($kgf/cm^2$) | 1.5 | 1.8 | 1.2 |
| tTP max (msec.) | 47 | 30 | 28 |
| tTP 90 (msec.) | 21 | 16 | 17 |
| Tank temperature (°C.) | 87 | 150 | 75 |
| CO concentration (%) | 0.63 | 0.64 | 0.48 |
| NOx concentration (ppm) | 1050 | 1050 | 1200 |

Table 1 reveals that the gas generating composition of the present invention exhibits equivalent burning velocity and is equivalently low in the concentration of toxic components such as CO and NOx in the after gas of the composition, compared with the gas generating composition comprising azodicarbonamide or biscarbamoylhydrazine as an active component.

Test Example 2

The burning temperature of the gas generating compositions of Example 1 and Comparative Examples 1 and 2 was calculated by a simulation based on a thermal equilibrium calculation program of NASA (S. Gordon and B. J. McBride, "A Computer Program for Complex Chemical Equilibrium Compositions-Incident and Reflected Shocks and Chapian Jouguet Detonations, NASA). The burning temperatures of the gas generating composition of Example 1, Comparative Example 1 and Comparative Example 2 were about 2200K (pressure: 70 kgf), about 2400K (pressure: 70 kgf) and about 2150K (pressure: 70 kgf), respectively.

As apparent from the above, the burning temperature of the gas generating composition of the present invention is lower by about 200K than that of the gas generating composition comprising azodicarbonamide as the gas generating base.

Further, it was revealed that the gas generating composition of the present invention shows burning temperature equivalent to that of the gas generating composition comprising biscarbamoylhydrazine as the gas generating base.

Test Example 3

The pellet sample of the gas generating composition obtained in Example 1 was stored in a constant temperature vessel at 107° C. for 400 hours. The remaining proportion (wt. %) was calculated to determine the degree of decomposition of the gas generating base. The remaining proportion of the gas generating composition of Example 1 was at least 99.5%, which proves that urazol substantially did not decompose. The remaining proportion (wt. %) of the pellet sample of the gas generating composition of Comparative Example 1 was determined in the same manner as above with the exception that the storing time was 190 hours, and found to be 75%. It was proved that azodicarbonamide considerably decomposed, even in less than half of the storing time of the pellet sample of the gas generating composition according to the present invention.

It is apparent from these results that the gas generating composition of the present invention is much higher in storage stability than the gas generating composition comprising azodicarbonamide as the gas generating base.

Test Example 4

Each of the pellet samples of the gas generating compositions obtained in Example 1 and Comparative Example 2 was set on a hardness tester (trade name "HARDNESS TESTER KHT-20N", product of Fujiwara Seisakusho K. K.) wherein the load (kg) on the pellet was gradually increased, and the load at which the pellet disintegrated was regarded as the hardness of the pellet. The hardness test was repeated several times to calculate the average value. The results are shown in Table 2.

TABLE 2

| | Number of determinations | Hardness of pellet (kg) |
|---|---|---|
| Example. 1 | 20 | 8.0 |
| Comp.Ex.2 | 20 | 2.8 |

It is apparent from Table 2 that the gas generating composition of the present invention has remarkably good moldability and high pellet strength, compared with the biscarbamoylhydrazine-based gas generating composition.

EXAMPLE 2

Thoroughly mixed together were powders of 45 parts of the gas generating base, 1 part of silicon dioxide, and potassium perchlorate and an inorganic salt of a metal in the amounts (part) shown in Table 3. A 20% aqueous solution of soluble starch was added in an amount that gives a starch content of 1.5 parts, and the mixture was further stirred to give a wet powder. The powder was granulated using a granulating machine, and the obtained wet granules were dried and compressed using a hydraulic tablet molding machine to give a pellet sample of an air bag gas generating composition of the present invention (6 mm in diameter, 3 mm in thickness and 0.15 g in weight).

TABLE 3

| | Amount of | Inorganic salt of metal | |
|---|---|---|---|
| No. | $KClO_4$ (part) | Kind | Amount (part) |
| 1 | 62.20 | $CaCO_3$ | 20 |
| 2 | 62.15 | $CaCO_3$ | 30 |
| 3 | 62.15 | $MgCO_3$ | 18.8 |
| 4 | 62.15 | $SrCO_3$ | 32.9 |
| 5 | 62.15 | $Mg(OH)_2$ | 6.5 |
| 6 | 50.10 | $K_2CO_3$ | 31 |

The pellet samples Nos. 1 to 5 of the gas generating compositions were heated at 120° C. for 2 hours to form a metal salt of urazol. The pellet sample No. 6, which contains $K_2CO_3$ as the inorganic salt of a metal, was not heated.

The pellet samples Nos. 1 to 6 were tested for burning performance in the same manner as in Test Example 1. The theoretical burning temperature of these gas generating compositions was calculated in the same manner as in Test Example 2. The results are shown in Table 4.

TABLE 4

| No. | 1 | 2 | 3 | 4 | 5 | 6 |
|---|---|---|---|---|---|---|
| Amount of pellet sample (g) | 40 | 40 | 40 | 40 | 40 | 40 |
| CP max (Kgf/cm$^2$) | 116 | 128 | 156 | 226 | 136 | 100 |
| TP max (kgf/cm$^2$) | 0.8 | 0.5 | 1.7 | 2.4 | 1.8 | 0.8 |
| Tank temperature (°C.) | 54 | 60 | 178 | 225 | 243 | — |
| CO concentration (%) | 0.48 | 0.61 | 0.27 | 0.13 | 0.32 | 0.65 |
| NOx concentration (ppm) | 1500 | 1500 | 500 | 1450 | 850 | 1500 |
| Theoretical burning temperature (K.) | 2090 | 2030 | 2050 | 2090 | 2150 | 1970 |

EXAMPLE 3

No.7: Thoroughly mixed together were powders of 45 parts of urazol, 52.05 parts of potassium perchlorate, 20 parts of potassium carbonate and 9 parts of silicon dioxide. A 20% aqueous solution of soluble starch was added in an amount that gives a starch content of 1.5 parts, and the mixture was further stirred to give a wet powder. The wet powder was granulated using a granulating machine, and the obtained wet granules were dried and compressed using a hydraulic tablet molding machine to give a pellet sample of the bag gas generating composition of the present invention (6 mm in diameter, 3 mm in thickness and 0.15 g in weight).

No.8: A pellet sample (6 mm in diameter, 3 mm in thickness and 0.15 g in weight) of the gas generating composition of the present invention was prepared in the same manner as in the preparation of the pellet sample No. 7 with the exception that the amounts of potassium perchlorate and silicon dioxide were changed to 54.95 wt. parts and 15 parts, respectively.

The pellet samples Nos. 7 and 8 of the gas generating compositions of the present invention were tested for burning performance in the same as in Test Example 1. The theoretical burning temperature of these gas generating compositions were calculated in the same manner as in Test Example 2. The results are shown in Table 5.

TABLE 5

| No. | 7 | 8 |
|---|---|---|
| Amount of pellet sample (g) | 40 | 40 |
| CP max (Kgf/cm$^2$) | 98 | 136 |
| TP max (kgf/cm$^2$) | 1.4 | 1.4 |
| Tank temperature (°C.) | 243 | 154 |
| CO concentration (%) | 0.58 | 0.29 |
| NOx concentration (ppm) | 650 | 1050 |
| Theoretical burning temperature (K.) | 1990 | 2000 |

We claim:

1. An air bag gas generating composition comprising, as active compounds, as least one gas generating base selected from the group consisting of urazole and a metal salt thereof, and an oxidizing agent selected from the group consisting of oxohalogen acid salts nitrites, metallic peroxides hyperoxides and ozone compounds.

2. An air bag gas generating composition comprising, as active compounds, as least one gas generating base selected from the group consisting of urazole and a metal salt thereof, an oxidizing agent selected from the group consisting of oxohalogen acid salts, nitrites, metallic peroxides hyperoxides and ozone compounds, and at least one member selected from the group consisting of a burning catalyst, a burning control agent and a slagging agent.

3. An air bag gas generating composition according to claim 1 or 2 wherein said at least one gas generating base is a mixture of urazole and a metal salt thereof.

4. An air bag gas generating composition according to claim 1 or 2 wherein the oxidizing agent is an oxohalogen acid.

5. An air bag gas generating composition comprising, as active compounds, a gas generating base consisting of urazole and a metal salt thereof, and an oxidizing agent.

6. An air bag gas generating composition according to claim 5, wherein said metal salt is selected from the group consisting of alkali metal salts, and alkali earth metal salts.

7. An air bag gas generating composition comprising, as active compounds, a gas generating base consisting of urazole and a metal salt thereof, an oxidizing agent, and at least one member selected from the group consisting of a burning catalyst, a burning control agent and a slagging agent.

8. An air bag gas generating composition according to claim 7, wherein said metal salt is selected from the group consisting of alkali metal salts, and alkali earth metal salts.

* * * * *

UNITED STATES PATENT AND TRADEMARK OFFICE

CERTIFICATE OF CORRECTION

PATENT NO. : 5,827,996

DATED : October 27, 1998

INVENTOR(S) : Tadao Yoshida, Yasuo Shimizu, Kazuo Hara, Shiro Chijiwa, and Junichi Onishi It is certified that error appears in the above-identified patent and that said Letters Patent is hereby corrected as shown below:

On the title page: Item [73] Assignee, delete "Otsuka Kagaku Kabushiki Kaish" and insert --Otsuka Kagaku Kabushiki Kaisha--.

Signed and Sealed this

Sixteenth Day of March, 1999

*Attest:*

*Attesting Officer*

Q. TODD DICKINSON

*Acting Commissioner of Patents and Trademarks*